US009709917B2

(12) United States Patent
Tanaka et al.

(10) Patent No.: US 9,709,917 B2
(45) Date of Patent: Jul. 18, 2017

(54) IMAGE FORMING APPARATUS AND LIGHT INTENSITY ADJUSTING METHOD

(71) Applicant: Konica Minolta, Inc., Tokyo (JP)

(72) Inventors: Toshiaki Tanaka, Toyokawa (JP); Yasuhiro Ishihara, Toyohashi (JP); Mineo Yamamoto, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/157,304

(22) Filed: May 17, 2016

(65) Prior Publication Data

US 2016/0349662 A1 Dec. 1, 2016

(30) Foreign Application Priority Data

May 27, 2015 (JP) ..... 2015-107621

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04054* (2013.01)

(58) Field of Classification Search
USPC ..... 399/1, 3, 4, 9, 31, 32, 38, 51, 177
See application file for complete search history.

(56) References Cited

U.S. PATENT DOCUMENTS 8,693,902 B2 * 4/2014 Watanabe ..... G03G 15/5058 399/49
2007/0242017 A1 * 10/2007 Mitsuse ..... B41J 2/45 345/92

FOREIGN PATENT DOCUMENTS

JP 09-156155 A 6/1997
JP 2003-334990 A 11/2003
JP 2007-260907 A 3/2006

* cited by examiner

*Primary Examiner* — Hoan Tran
(74) *Attorney, Agent, or Firm* — Buchanan Ingersoll & Rooney PC

(57) ABSTRACT

An image forming apparatus includes: an array of m light-emitting elements extending in a main scanning direction, the m being an integer satisfying m≥3; a memory that stores a cumulative light emission time of each of the m light-emitting elements; a light intensity adjusting portion that obtains a light intensity adjusting value for the each light-emitting element; an activating portion that controls the activation and deactivation of the each light-emitting element with the light intensity adjusting value; and a selecting portion that selects n light-emitting elements from an end of the array, the n being an integer satisfying n≥2 and n<m, wherein the activating portion forcibly activates the n light-emitting elements such that the cumulative light emission times of them are adjusted to a predetermined typical value less than the greatest value of cumulative light emission time among the m−n light-emitting elements.

16 Claims, 5 Drawing Sheets

IMAGE FORMING APPARATUS AND LIGHT INTENSITY ADJUSTING METHOD

This application claims priority under 35 U.S.C. §119 to Japanese Patent Application No. 2015-107621 filed on May 27, 2015, the entire disclosure of which is incorporated herein by reference in its entirety.

BACKGROUND OF THE INVENTION

Field of the Invention

The present invention relates to: an electro-photographic image forming apparatus that is provided with a print head serving as an exposing portion and including an array of multiple light-emitting elements extending in a main scanning direction; and a light intensity adjusting method for the image forming apparatus.

Description of the Related Art

The following description sets forth the inventor's knowledge of related art and problems therein and should not be construed as an admission of knowledge in the prior art.

As is well-known, the light intensity of a light-emitting element used in such an image forming apparatus as described above decreases because light-emitting elements are degraded with their cumulative light emission times. The light-emitting elements have different cumulative light emission times because documents to be printed are frequently put at different positions in a main scanning direction. This means, the light-emitting elements normally do not have the same degradation level on light intensity. The light-emitting elements emit light at different light intensities, causing the unevenness of toner density in a developed image. That is the reason that conventional image forming apparatuses are configured to adjust the light intensities of all the light-emitting elements at a certain time, e.g., before a document is exposed to light. This is called light intensity adjustment in this Specification.

One of the conventional image forming apparatuses is, for example, an electrographic apparatus described in Japanese Patent Application Laid-open Publication No. 2003-334990. This conventional image forming apparatus is provided with an exposing portion including an array of multiple light-emitting elements extending in a main scanning direction; it generates an electrostatic latent image on the surface of a photoconductor rotating while being charged, by controlling the turning on and off of all the light-emitting elements.

The image forming apparatus counts up how many times each light-emitting element has been turned on, and unnecessarily repeats turning on the light-emitting elements other than the light-emitting element having been turned on the most times. Accordingly, as described in Japanese Patent Application Laid-open Publication No. 2003-334990, the degradation conditions of all the light-emitting elements are adjusted to the same level, and light intensity adjustment is performed without complexity.

Also, as described in Japanese Patent Application Laid-open Publication No. 2003-334990, the degradation conditions of all the light-emitting elements are adjusted to that of the light-emitting element having been turned on the most times. Accordingly, the light-emitting elements are degraded unnecessarily fast, making the lifetime of the exposing portion short.

SUMMARY OF THE INVENTION

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

A first aspect of the present invention relates to an image forming apparatus being configured to print an image on a recording medium, the image being formed on a photoconductor, the image forming apparatus including:

an array of m light-emitting elements, the array extending in a main scanning direction, the array being disposed at a position adjacent to a surface of the photoconductor, the variable m being an integer satisfying the inequality: $m \geq 3$;

a memory that stores a cumulative light emission time of each of the m light-emitting elements;

a light intensity adjusting portion that obtains a light intensity adjusting value for the each light-emitting element, the light intensity adjusting value for adjusting a light intensity of the each light-emitting element;

an activating portion that controls the activation and deactivation of the each light-emitting element with reference to the light intensity adjusting value to form an electrostatic latent image on the surface of the photoconductor; and a selecting portion that selects n light-emitting elements from the m light-emitting elements, the n light-emitting elements being disposed on an end of the array extending in the main scanning direction, the variable n being an integer satisfying the inequality: $n \geq 2$ and $n < m$, wherein the activating portion forcibly activates the n light-emitting elements such that the cumulative light emission times of the n light-emitting elements are adjusted to a predetermined typical value, the predetermined typical value being less than the greatest value of cumulative light emission time among the m−n light-emitting elements.

A second aspect of the present invention relates to a light intensity adjusting method for an image forming apparatus being configured to print an image on a recording medium, the image being formed on a photoconductor, the image forming apparatus including:

an array of m light-emitting elements, the array extending in a main scanning direction, the array being disposed at a position adjacent to a surface of the photoconductor, the variable m being an integer satisfying the inequality: $m \geq 3$; and a memory that stores a cumulative light emission time of each of the m light-emitting elements, the light intensity adjusting method including:

obtaining a light intensity adjusting value for the each light-emitting element, the light intensity adjusting value for adjusting a light intensity of the each light-emitting element;

controlling the activation and deactivation of the each light-emitting element with reference to the light intensity adjusting value to form an electrostatic latent image on the surface of the photoconductor; and selecting n light-emitting elements from the m light-emitting elements, the n light-emitting elements being disposed on an end of the array extending in the main scanning direction, the variable n being an integer satisfying the inequality: $n \geq 2$ and $n < m$, wherein the n light-emitting elements are forcibly activated such that the cumulative light emission times of the n light-emitting elements are adjusted to a predetermined typical value, the predetermined typical value being less than the greatest value of cumulative light emission time among the m−n light-emitting elements.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying drawings, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, an image forming apparatus will be described in details with reference to the accompanying drawings.

First Section: Definition

Figure 1:
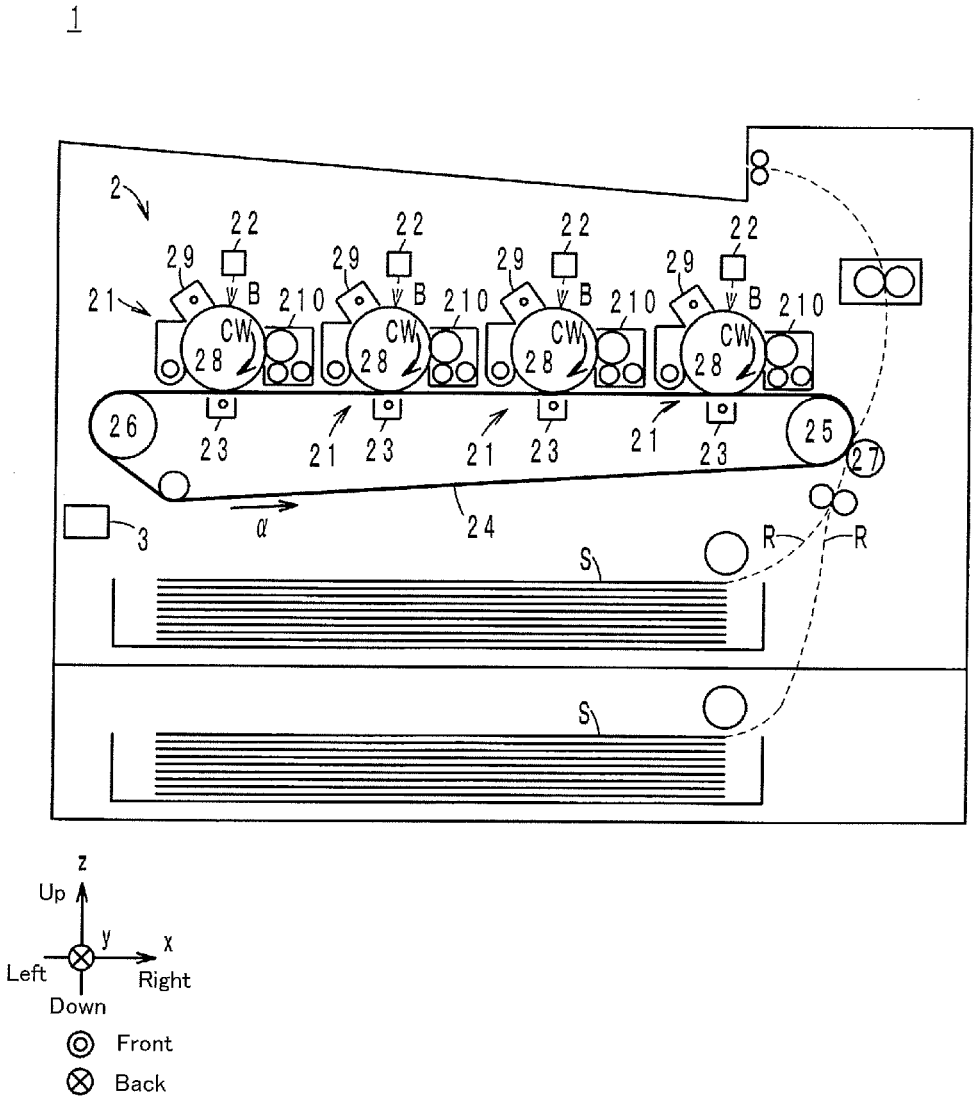
FIG. 1 schematically illustrates a vertical cross-section of an image forming apparatus.

As illustrated in FIG. 1 and other figures, an image forming apparatus 1 has an x-axis extending in its right-left directions, a y-axis extending in its front-back directions, and a z-axis extending in its up-down directions. The y-axis represents main scanning directions in which an optical beam B travels. From this perspective, the main scanning directions sometimes have a reference code "y" in this Specification.

Second Section: Print Operation of the Image Forming Apparatus

As illustrated in FIG. 1, the image forming apparatus 1 is a printer, a copier, a facsimile, or a multi-function peripheral (MFP) having printer function, copier function, and facsimile function, for example. Upon receipt of a print job, the image forming apparatus 1 starts performing the following operations: forming toner images in the colors of yellow (Y), magenta (M), cyan (C), and black (K) on the surfaces of YMCK photoconductor drums 28; consolidating the YMCK toner images on an intermediate transfer belt 24; and transferring the consolidated toner image to a recording medium S. Hereinafter, the operations to be performed in the image forming apparatus 1 during execution of a print job will be described in details.

In the image forming apparatus 1, a feeder unit provides recording mediums S of a size specified by the print job, one by one to its conveyor path R to direct them to a pair of timing rollers in the downstream. The pair of timing rollers briefly stops rotating to stop a recording medium S by its nipple. The pair of timing rollers then starts rotating again to direct the recording medium S to a second transfer area to be later described.

The image forming apparatus 1 is provided with a process unit 2. The process unit 2 includes a set of an image forming portion 21, an OLED-PH 22, and a transfer portion 23 for each color of the YMCK model. The process unit 2 further includes an intermediate transfer belt 24, a driving roller 25, a driven roller 26, and a second transfer roller 27.

Each image forming portion 21 is essentially provided with a photoconductor drum 28, an electrostatic charging portion 29, and a developing portion 210. The electrostatic charging portion 29 and the developing portion 210 are disposed at positions adjacent to the periphery of the photoconductor drum 28. The YMCK photoconductor drums 28 are disposed alongside each other to the right-left directions. The YMCK photoconductor drums 28 extend parallel to the y-axis; each photoconductor drum 28 rotates about its central axis in a clockwise direction (in a rotation direction CW pointed by an arrow). The opposite direction to the rotation direction CW corresponds to a sub scanning direction in which the optical beam B travels. The YMCK electrostatic charging portions 29 extend parallel to the y-axis; each electrostatic charging portion evenly charges the periphery of the photoconductor drum 28.

Figure 2:
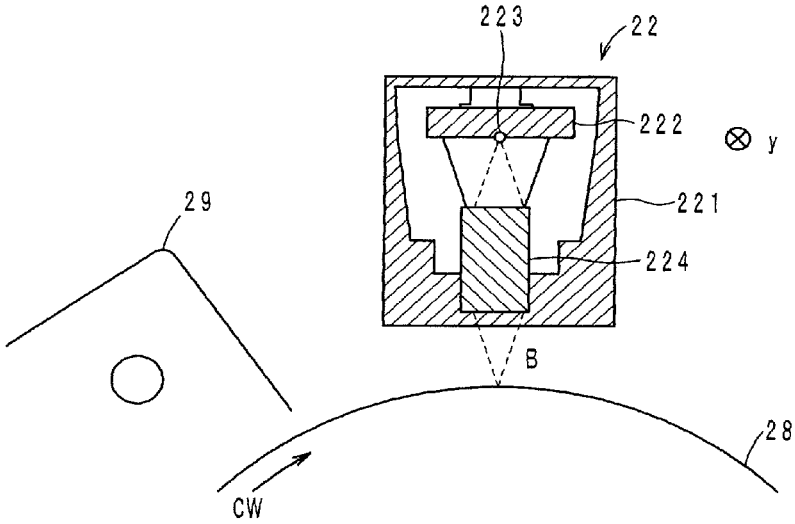
FIG. 2 illustrates a vertical cross-section of an OLED-PH from FIG. 1.

Each OLED-PH 22 is a representative example of an exposing portion. As illustrated in FIG. 2, each OLED-PH 22 is disposed at a position adjacent to the periphery of the photoconductor drum 28 in the downstream of the electrostatic charging portion 29 in the rotation direction CW. Each OLED-PH 22 includes a holder 221 containing an OLED baseplate 222, a light-emitting element array 223, and a lens array 224 all of which are fixed in place in the holder 221.

Each light-emitting element array 223 includes multiple light-emitting elements 225 represented by organic light emitting devices (OLEDs) (refer to FIG. 3) and an activator circuit activating the light-emitting elements 225. The light-emitting elements 225 are aligned in a linear array on the OLED baseplate 222 such that they emit light toward the surface of the photoconductor drum 28. The light-emitting elements 225 are activated and deactivated under the control of an ASIC 32 and an activator IC 226 both of which will be later described.

Figure 4:
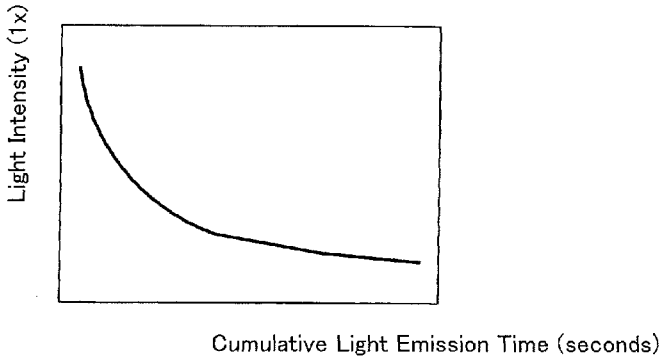
FIG. 4 is a chart showing how the light intensity of a light-emitting element (OLED) changes with the cumulative light emission time.

With reference to FIG. 4, the light intensity of an OLED decreases with cumulative light emission time even when a constant driving voltage is applied. Specifically, light intensity greatly decreases in an early stage because cumulative light emission time is still short in that stage.

Figure 3:
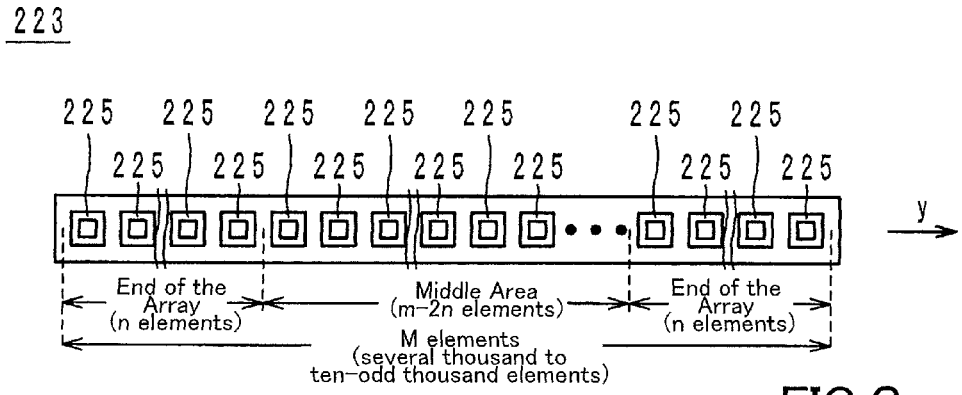
FIG. 3 schematically illustrates light-emitting elements in a light-emitting element array from FIG. 2.

With reference to FIG. 3, the total number of the light-emitting elements 225 in each light-emitting element array 223 is represented by m. M is basically an integer equal to or greater than three. Specifically, m is determined by the following factors: the length of a side of the recording medium S having the largest size supported by the image forming apparatus 1 (for example, the length of a shorter side of a A3-sized recording medium S); and the number of pixels per unit length arrayed in a main scanning direction y. M is a value of several thousands to ten-odd thousands, for example.

Some of the light-emitting elements 225, which are on each end of the light-emitting element array 223 extending in a main scanning direction y, are less frequently used during image forming. So, the light-emitting elements 225 on each end of the array have cumulative light emission times less than those of the other light-emitting elements 225. The number of the light-emitting elements 225 on each end of the array is represented by n, and n is basically an integer satisfying the inequalities: $n \geq 2$ and $n < m$. N changes depending on the size of the recording medium S used for image forming. The image forming apparatus 1 are configured to originally store a table T1 containing n, i.e., the number of light-emitting elements on each end of the array, for each size of the recording medium S (refer to Table 1). The table 1 is used during execution of a print job (Step S08, FIG. 6), for example, and is stored on a recording medium such as a flash memory 33 to be later described.

TABLE 1

Table T1

| Recording Medium S | A3 Portrait | B4 Portrait | A4 Portrait | A4 andscape | . . . |
|---|---|---|---|---|---|
| N Light-emitting Elements on Each End of the Array | n1 | n2 | n3 | n4 | . . . |

Each lens array 224 is comprised of a microlens array (MLA) or an optical transmitter array with light-harvesting functionality, and has multiple gradient index lenses (GIL) arrayed in a main scanning direction y. Each lens array 224 is disposed at a position between the light-emitting element array 223 and the photoconductor drum 28 such that the optical axes of the gradient index lenses are in parallel with the light axes of the light-emitting elements 225. Collecting incident light from the light-emitting elements 225, each lens array 224 produces the optical beam B and directs it to the surface of the photoconductor drum 28. The above-described configuration allows each OLED-PH 22 to emit its optical beam B traveling in a main scanning direction y, to the periphery of the photoconductor drum 28. While the photoconductor drum 28 rotates in the rotation direction CW pointed by an arrow, the optical beam B also travels in a sub scanning direction corresponding to the rotation direction CW. Accordingly, an electrostatic latent image is formed on the periphery of each photoconductor drum 28.

The description will continue with reference to FIG. 1 again. The YMCK developing portions 210 extend parallel to the y-axis; each developing portion 210 is disposed at a position adjacent to the periphery of the photoconductor drum 28 in the downstream of the destination of the optical beam B. Each developing portion 210 supplies toner to the periphery of the photoconductor drum 28. Accordingly, an electrostatic latent image is formed on the periphery of the photoconductor drum 28 and developed into a toner image (unicolor image).

As a result of the above-described developing process, each photoconductor drum 28 carries a unicolor toner image on its periphery. With the rotation of each photoconductor drum 28, the toner image is conveyed downstream to the rotation direction CW.

The YMCK transfer portions 23 extend parallel to the y-axis; each transfer portion 23 is disposed at a position in the downstream of of the developing portion 210 such that the intermediate transfer belt 24 is sandwiched between the transfer portion 23 and the photoconductor drum 28.

The intermediate transfer belt 24 is an endless belt supported by the driving roller 25 and the driven roller 26. The intermediate transfer belt 24 is sandwiched between the YMCK transfer portions 23 and the YMCK photoconductor drums 28 such that it is rotatable in a direction a pointed by an arrow. Each transfer portion 23 forms a first transfer area by firmly pressing the intermediate transfer belt 24 to the photoconductor drum 28.

A bias voltage is applied to each transfer portion 23. At the first transfer area, the toner image carried on each photoconductor drum 28 is electrostatically transferred to the outer periphery of the intermediate transfer belt 24 (first transfer process). That is, the YMCK toner images are transferred such that they are overlaid on top of each other in the same area on the surface of the intermediate transfer belt 24. With the rotation of the intermediate transfer belt 24, the consolidated toner image is conveyed to the second transfer roller 27.

The second transfer roller 27 is disposed such that the intermediate transfer belt 24 is sandwiched between the second transfer roller 27 and the driving roller 25; each second transfer roller 27 forms a second transfer area by firmly pressing the intermediate transfer belt 24 to the driving roller 25. A bias voltage is also applied to each second transfer roller 27. At the second transfer area, the consolidated toner image carried on the intermediate transfer belt 24 is electrostatically transferred to the recording medium S (second transfer process).

A fusing portion fuses the consolidated toner image to the recording medium S by applying heat and pressure to the recording medium S carrying the consolidated toner image. A pair of discharge rollers then discharges this recording medium S to a discharge tray as a print.

To control all the above-described portions, the image forming apparatus 1 is provided with a controller portion 3. The controller portion 3 is comprised of a CPU, a main memory, and other portions, and controls the printing of the image forming apparatus 1 in accordance with programs stored thereon.

Third Section: Controller Portion and OLED-PH

Figure 5:
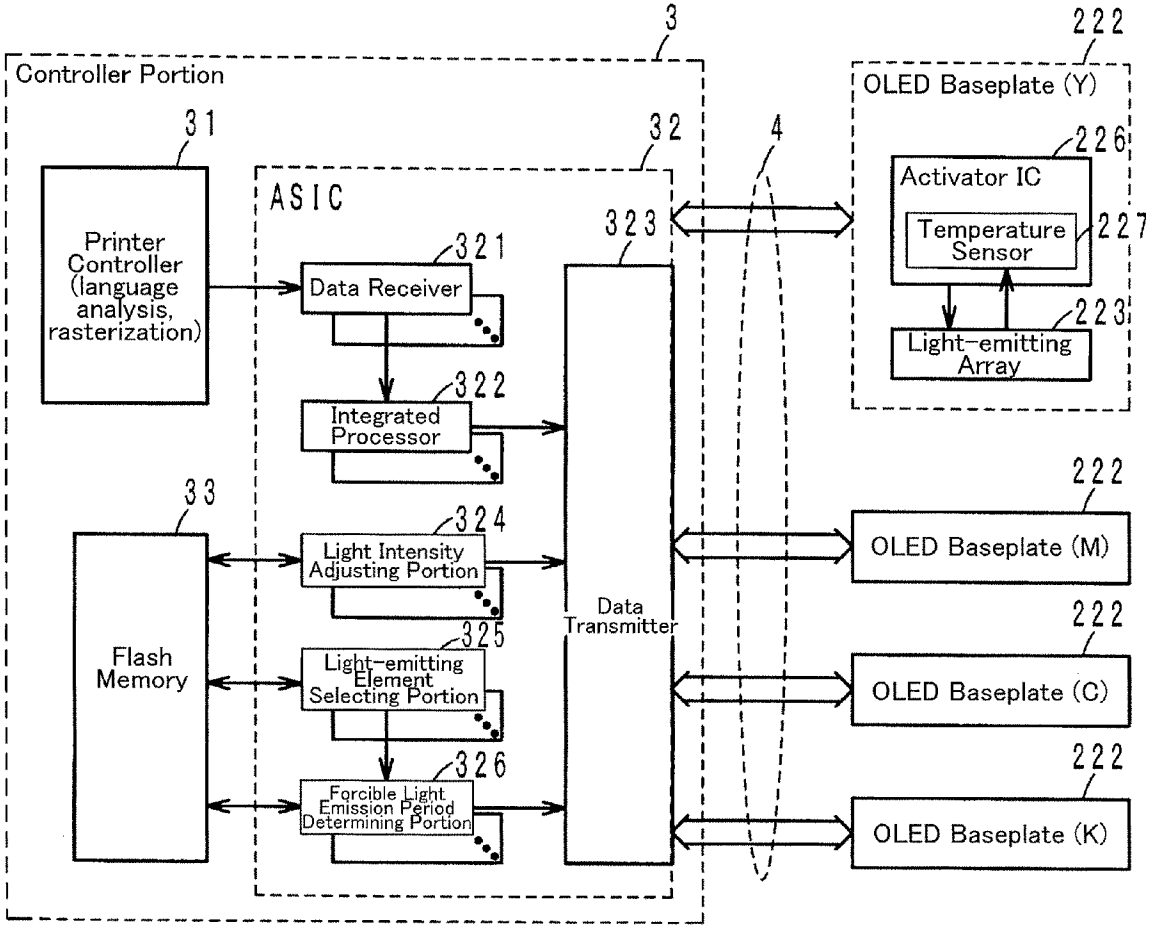
FIG. 5 illustrates a control block diagram of the OLED-PH from FIG. 1.

The controller portion 3 controls the light emission of the OLED-PH 22 (to be later described in details) during execution of a print job. To control this, as illustrated in FIG. 5, the controller portion 3 includes a printer controller 31, an ASIC 32, and a flash memory 33.

The printer controller 31 substantially performs language analysis and rasterization. In regard to language analysis, the printer controller 31 receives a print job described in a predetermined page description language, and analyzes the page description language in each recording medium S (i.e. each page of a document). The printer controller 31 then generates an intermediate data object, which is referred to as "display list", in a memory (not shown in this figure).

In regard to rasterization, the printer controller 31 performs the following operations: retrieving the display list (intermediate data object) from the memory; performing a graphics process (color conversion) and a screen process; and generating YMCK raster data objects such as binary images at 1200 pixels per inch (ppi), for example, in a frame format.

The ASIC 32 is an application specific integrated circuit including YMCK data receivers 321, YMCK integrated processors 322, and YMCK data transmitters 323, as function blocks. Each data receiver 321 receives a raster data object from the printer controller 31. Each integrated processor 322 performs various processes on the received raster data object in the memory. Specifically, each integrated processor 322 performs skew correction on the raster data object and dot counting to obtain the number of times each light-emitting element 225 is activated. After that, each data transmitter 323 transmits the raster data object having been subjected to the various processes, to the activator IC 226 through an electrical cable such as a flexible flat cable (FFC) 4. It is preferred that the raster data object be transmitted by a high-speed transmission method such as low voltage differential signaling (LVDS).

The ASIC 32 further includes YMCK light intensity adjusting portions 324, YMCK light-emitting element selecting portions 325, and YMCK forcible light emission period determining portions 326, as function blocks. During execution of a print job, each light intensity adjusting portion 324 obtains light intensity adjusting values V for the m light-emitting elements 225. Each light-emitting element selecting portion 325 selects n light-emitting elements 225 on each end of the array (i.e. the light-emitting elements 225 less frequently used during execution of a print job). Each light-emitting element selecting portion 325 selects n light-emitting elements 225 on each end of the array (i.e. a total of 2n light-emitting elements 225). Normally, n is a common value among YMCK. After execution of a print job, each forcible light emission period determining portion 326 determines the times (to be referred to as "forcible light emission periods") t0 to forcibly activate the selected 2n light-emitting elements 225. Specifically, each forcible light emission period determining portion 326 determines forcible light emission periods t0 for the 2n light-emitting elements 225 such that the cumulative light emission times t1 of the 2n light-emitting elements 225 are adjusted to a predetermined typical value t1typ. Each data transmitter 323 further transmits the light intensity adjusting values V, which are obtained by the light intensity adjusting portion 324, and the forcible light emission periods t0, which are determined by the forcible light emission period determining portion 326, to the activator IC 226 through the FFC 4, as control data. The control data is transmitted through a serial bus such as an I2C (also known as "I-squared-C") serial bus. The operations of these portions will be later described in details.

The ASIC 32 further transmits control data that defines the activation times for the light-emitting elements 225, such as a line synchronization signal and a clock signal, to the YMCK activator ICs 226 through the FFC 4.

The flash memory 33 stores tables T1 to T4 for the ASIC 32 to perform various processes. The table T1 is already described above in the previous section. There are a table T2, a table T3 and a table T4 for each color of the YMCK model. Each table T2 contains cumulative light emission times t1 for the m light-emitting elements 225 (refer to Table 2), and each table T3 contains degradation levels d for the m light-emitting elements 225 (refer to Table 3). The cumulative light emission times t1 are set to zero by default. The degradation levels d are also set to zero by default, and show greater values with the progress of degradation of the light-emitting elements 225. The table T4 contains reference temperatures t2 for the YMCK OLED baseplates 222, which are measured during execution of the last print job (refer to Table 4). Table 2 shows an example of the table T2 for Y, and Table 3 shows an example of the table T3 for Y.

TABLE 2

| Table T2(Y) | | | | | |
|---|---|---|---|---|---|
| | Light-emitting Element 225(Y) | | | | |
| | 1 | 2 | 3 | 4 | . . . |
| Cumulative Light Emission Time t1(Y)(sec) | t1(Y1) | t1(Y2) | t1(Y3) | t1(Y4) | . . . |

TABLE 3

| Table T3(Y) | | | | | |
|---|---|---|---|---|---|
| | Light-emitting Element 225(Y) | | | | |
| | 1 | 2 | 3 | 4 | . . . |
| Degradation level d(Y) | d(Y1) | d(Y2) | d(Y3) | d(Y4) | . . . |

TABLE 4

| Table T4 | | | | |
|---|---|---|---|---|
| | Color | | | |
| | Y | M | C | K |
| Baseplate Temperature t2(° C.) | t2(Y) | t2 (M) | t2(C) | t2 (K) |

As illustrated in FIG. 5, each OLED baseplate 222 is essentially provided with the above-described light-emitting element array 223 and the activator IC 226. For simplicity in drawing, FIG. 5 illustrates a configuration of the Y OLED baseplate 222 as a representative.

During execution of a print job, each activator IC 226 performs the following operations: receiving a raster data object and various control data objects; adjusting the activation times in accordance with a clock signal or a line synchronization signal; applying the light intensity adjusting values V to the corresponding light-emitting elements 225; and controlling the turning on and off (the activation and deactivation) of the light-emitting elements 225 with reference to the raster data object. Accordingly, the light-emitting elements 225 emit light at the adjusted light intensities, preventing the unevenness of toner density in a developed image.

Each activator IC 226 has at least one temperature sensor 227. Each temperature sensor 227 senses the temperature of the OLED baseplate 222 at a predetermined time and transmits a baseplate temperature t2 to the ASIC 32 through the FFC 4.

After execution of a print job, each activator IC 226 performs the following operations: adjusting the activation times in accordance with a line synchronization signal or other data; applying the light intensity adjusting values V to the 2n light-emitting elements 225 less frequently used; and turning on the 2n light-emitting elements 225 for the received forcible light emission periods t0.

Fourth Section: Light Intensity Adjustment and Forcible Light Emission

Hereinafter, the operations to be performed in the image forming apparatus 1 will be further described in details with reference to FIG. 6.

Figure 6:
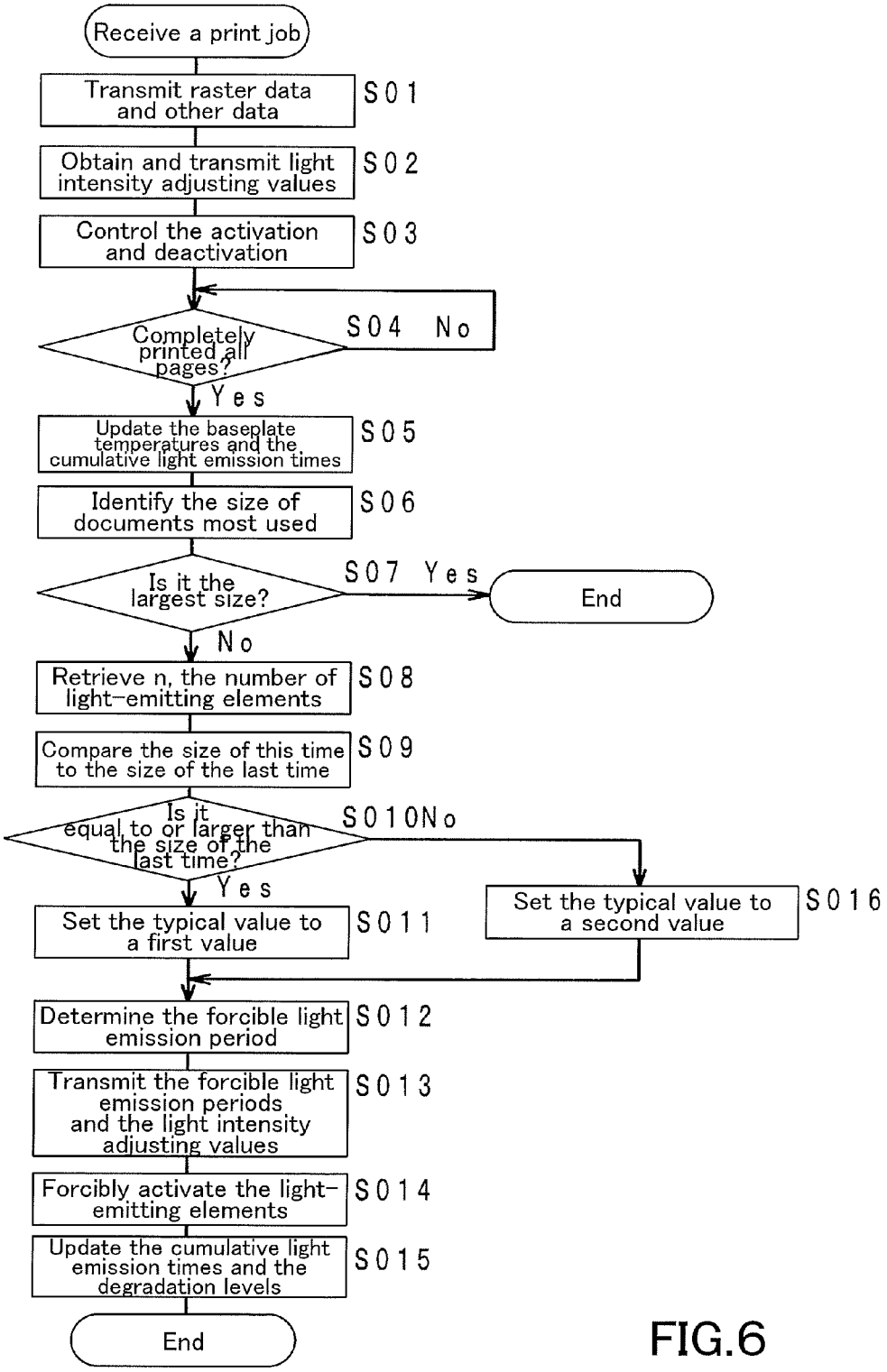
FIG. 6 is a flowchart representing the operation of the image forming apparatus.

As referred to FIG. 6, the image forming apparatus 1 starts its operation upon receipt of a print job: as described above, the printer controller 31 generates YMCK raster data objects and the ASIC 32 transmits the YMCK raster data objects, a line synchronization signal, and other data to the YMCK activator ICs 226 (Step S01).

Each light intensity adjusting portion 324 performs the following processes before execution of the print job (Step S02). In Step S02, each light intensity adjusting portion 324 retrieves the degradation levels d of the m light-emitting elements 225 from the table T3, and obtains light emission characteristic values C for the m light-emitting elements 225. The light emission characteristic values C are values for adjusting the time degradation of the light-emitting elements 225 and are basically correlated with the degradation levels d. Each light intensity adjusting portion 324 obtains a baseplate temperature t2 from the temperature sensor 227. Each light intensity adjusting portion 324 further obtains a target light intensity L (1×) for the m light-emitting elements 225. After that, by the following formula (1), each light intensity adjusting portion 324 obtains light intensity adjusting values V for the m light-emitting elements 225.

$$V=K2\times C\times L\times t2 \quad (1)$$

In accordance with the formula (1), each light intensity adjusting portion 324 obtains a light intensity adjusting value V by multiplying with the following factors: the baseplate temperature t2, the light-emission characteristic value C, the target light intensity L, and a factor K2. The factor K2 is a value for converting the adjusted value to a voltage value for voltage to be applied to the light-emitting element 225. The factor K2 is a value properly determined from the results of experiments, for example, in a phase of the design and development of the image forming apparatus 1.

The image forming apparatus 1 is configured to adjust the cumulative light emission times t1 of the 2n light-emitting elements to a typical value t1typ. by forcible light emission, which will be later described. Accordingly, the degradation levels d of the 2n light-emitting elements 225 are also adjusted (refer to the formula (2) to be described later). If the degradation levels d of the 2n light-emitting elements 225 are already adjusted in Step S02, the light intensity adjusting portion 324 uses other light intensity adjusting values V than those that can be obtained by the formula (1). That is, in this case, the light intensity adjusting portion 324 calculates light intensity adjusting values V for the 2n light-emitting elements 225 at one time.

Subsequently, each light intensity adjusting portion 324 transmits the light intensity adjusting values V to the activator IC 226 (Step S02).

The controller portion 3 starts printing upon completion of preparations. When it starts printing, the portions constituting the image forming apparatus 1 performs their operations as described above. Specifically, in the exposure process of printing, each activator IC 226 performs the following operations: adjusting the activation times in accordance with a line synchronization signal or other data; applying the received light intensity adjusting values V to the corresponding light-emitting elements 225; and controlling the light emission of the light-emitting elements 225 in accordance with a raster data object (Step S03). Step S03 is repeated until all pages specified by a print job are completely printed (Step S04).

When all the pages are completely printed, the ASIC 32 updates the tables (Step S05). Details of this will follow. The ASIC 32 performs the following operations: obtaining a baseplate temperature t2 measured after execution of the print job, from each temperature sensor 227; updating the values in the table T4; and adding the times the m light-emitting elements 225 continue emitting light during execution of the current print job, to the cumulative light emission times t1 in the table T2.

Each light-emitting element selecting portion 325 identifies the size of the recording mediums S most used during execution of the current print job (Step S06). Each light-emitting element selecting portion 325 judges whether or not the identified size is the largest size (A3, for example) supported by the image forming apparatus 1 (Step S07). Yes in this step means that all the light-emitting elements 225 are frequently used and forcible light emission is not needed. Each light-emitting element selecting portion 325 then terminates the flowchart of FIG. 6.

In contrast, No in Step S07 means that forcible light emission is needed. Each light-emitting element selecting portion 325 retrieves n, i.e., the number of light-emitting elements on each end of the array, which corresponds to the size identified in Step S06, from the table T1, and transmits it to the forcible light emission period determining portion 326 (Step S08).

Each forcible light emission period determining portion 326 compares the size identified in Step S06 after execution of the current print job (to be referred to as "size of this time") to the size identified in Step S06 after execution of the last print job (to be referred to as "size of the last time") (Step S09).

Figure 7A:
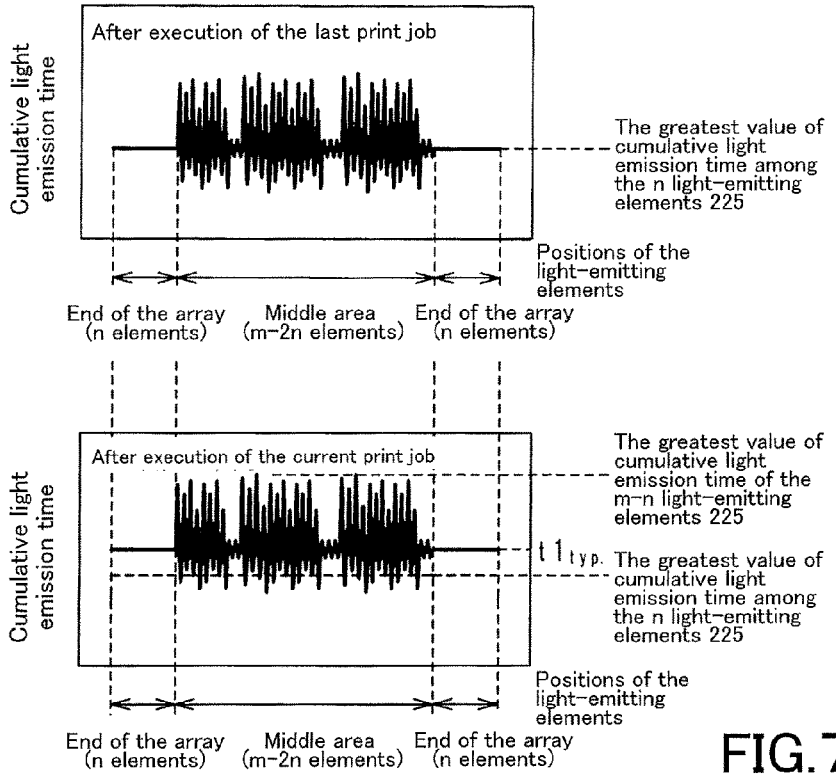
FIG. 7A is a chart showing a typical value obtained in Step S011 of FIG. 6.

As a result of comparison in Step S09, if the size of this time is equal to or larger than the size of the last time (Yes in Step S010), each forcible light emission period determining portion 326 sets the predetermined typical value t1typ. to a first value that is equal to or greater than the greatest value of cumulative light emission time t1 among the 2n light-emitting elements 225 and is less than the greatest value of cumulative light emission time t1 among the (m−2n) light-emitting elements 225 (Step S011), as shown in FIG. 7A.

Each forcible light emission period determining portion 326 determines the forcible light emission periods t0 for the 2n light-emitting elements 225 by subtracting the cumulative light emission times t1 of the 2n light-emitting elements 225 from the predetermined typical value t1typ (Step S012).

After Step S012, while the printing process is being terminated, each forcible light emission period determining portion 326 transmits the forcible light emission periods t0 to the activator IC 226 and each light intensity adjusting portion 324 transmits the light intensity adjusting values V to the activator IC 226 (Step S013). In this step, the ASIC 32 also transmits a line synchronization signal or other data to the YMCK activator IC 226 if needed. Each activator IC 226 performs the following operations: adjusting the activation times in accordance with a line synchronization signal or other data; applying the received light intensity adjusting values V to the corresponding light-emitting elements 225; and forcibly activating the light-emitting elements 225 for the forcible light emission periods t0 (Step S014). Accordingly, as referred to the lower chart in FIG. 7A, the cumulative light emission times t1 of the 2n light-emitting elements 225 are adjusted to the predetermined typical value t1typ. indicated by a solid line.

Subsequently, each forcible light emission period determining portion 326 updates the tables T2 and T3 (Step S015). Specifically, each forcible light emission period determining portion 326 updates the cumulative light emission times t1 of the 2n light-emitting elements 225 in the table T2 with the predetermined typical value t1typ. Each forcible light emission period determining portion 326 further obtains degradation levels d for the m light-emitting elements 225 by the following formula (2), and updates the degradation levels d of the m light-emitting elements 225 in the table T3 with the obtained ones.

$$d=K1\times t1\times V\times t2 \quad (2)$$

In accordance with the formula (2), each forcible light emission period determining portion 326 obtains a degradation level d by multiplying with the following factors: the cumulative light emission time t1, the light intensity adjusting value V, the baseplate temperature t2 measured after execution of the print job, and a factor K1. The factor K1 is a reasonable value determined from the results of experiments, for example, in a phase of the design and development of the image forming apparatus 1.

Figure 7B:
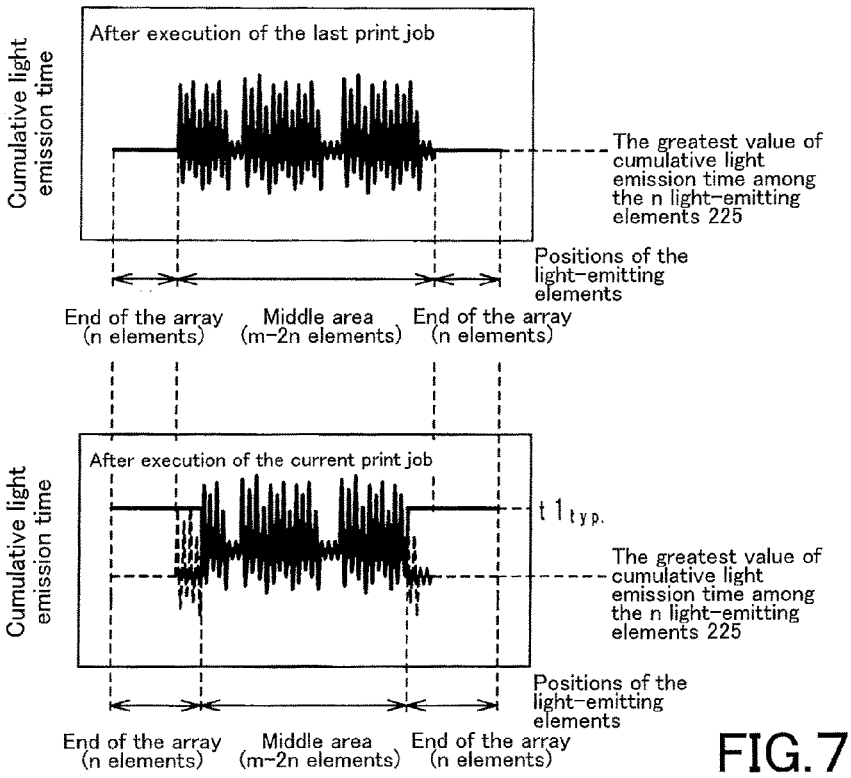
FIG. 7B is a chart showing a typical value obtained in Step S016 of FIG. 6.

As a result of comparison in Step S09, if the size of this time is not equal to or larger than the size of the last time (No in Step S010), each forcible light emission period determining portion 326 sets the predetermined typical value t1typ. to a second value that is the greatest value of cumulative light emission time t1 among the 2n light-emitting elements 225 (Step S016), as shown in FIG. 7B.

After Step S016, the ASIC 32 performs the processes of Steps S012 to S015 as described above. Accordingly, as referred to the lower chart in FIG. 7B, the cumulative light emission times t1 of the 2n light-emitting elements 225 are adjusted to the predetermined typical value t1typ. indicated by a solid line.

Fifth Section: Results and Effect of Forcible Light Emission

As described above, the image forming apparatus 1 is configured to adjust the cumulative light emission times t1 of the 2n light-emitting elements 225 less frequently used to a predetermined typical value (it must be less than the greatest value of cumulative light emission time t1 among the m−2n light-emitting elements 225), after execution of a print job. The (m−2n) light-emitting elements 225 are not forcibly activated after execution of a print job, which will contributes to the maintenance of the lifetime of the OLED-PH 22.

While most image forming apparatuses are configured to obtain light intensity values for the light-emitting elements by performing a feedback control with values detected by their light intensity sensors, the image forming apparatus 1 is configured to obtain light intensity adjusting values V by the formula (1), not by performing a feedback control. The image forming apparatus 1 is also configured to obtain light intensity adjusting values V for the m light-emitting elements 225 because of its systematic constraints or manageable limits; that is, it has a system configuration that fails to reduce the workload on the ASIC 32. The image forming apparatus 1 is, however, configured to adjust the cumulative light emission times t1 of the 2n light-emitting elements less frequently used during execution of a print job, and thus calculate light intensity adjusting values V for the 2n light-emitting elements 225 at one time during execution of a next print job. This will contribute to a reduction in the number of times the ASIC 32 operates for calculation and in the workload on the ASIC 32.

The image forming apparatus 1 is also configured to perform forcible light emission while a printing process is being terminated. In other words, forcible light emission is performed while the developing portion 210 is not performing a developing process. This will contribute to the saving of toner.

Sixth Section: Modifications

In the above-described embodiment, each activator IC 226 forcibly activates the 2n light-emitting elements 225 by applying the light intensity adjusting values V used for latent image formation, to the corresponding light-emitting elements 225 for the forcible light emission periods t0 (Step S014). Alternatively, each activator IC 226 may forcibly activate the 2n light-emitting elements 225 by applying voltage values that are lower than the light intensity adjusting values V used for latent image formation, to the corresponding light-emitting elements 225 for the forcible light emission periods t0. Still alternatively, each activator IC 226 may forcibly activate the 2n light-emitting elements 225 by intermittently applying the light intensity adjusting values V or other voltage values to the corresponding light-emitting elements 225 for the forcible light emission periods t0. These modifications will contribute to a reduction in heat generated by the 2n light-emitting elements 225.

Seventh Section: Supplemental Description

In the above-described embodiment, the light-emitting elements 225 are OLEDs; alternatively, they may be laser diodes or light-emitting diodes.

In the above-described embodiment, light intensity adjusting values V are voltage values; alternatively, they may be injected current values.

In the above-described embodiment, the ASIC 32 preferably obtains light intensity adjusting values V. The ASIC 32 may obtain light intensity adjusting values V for the light-emitting elements 225 by performing a feedback control with values detected by light intensity sensors.

In the above-described embodiment, the light-emitting element array 223 extending in a main scanning direction y has n light-emitting elements 225 less frequently used on each end of itself, as an configuration example. In other words, an electrostatic latent image is more frequently formed in the middle of the array extending in front-back directions (in a main scanning direction y) on the periphery of the photoconductor drum 28. Alternatively, the image forming apparatus 1 may have such a configuration that allows the light-emitting element array 223 extending in a main scanning direction y to have n light-emitting elements 225 less frequently used on one end of itself, as an extreme example. In other words, an electrostatic latent image may be more frequently formed in an image forming area on a front end (or a back end) of the array on the periphery of the photoconductor drum 28, and the light-emitting element array 223 extending in a main scanning direction y have n light-emitting elements 225 less frequently used on its front end (or its back end). The operations and processes described in the embodiment are also applicable to these examples.

INDUSTRIAL APPLICABILITY

The image forming apparatus according to the present invention is preferred to be applied as a facsimile, a copier, a printer, and a multifunctional apparatus having the functions of a facsimile, a copier, and a printer regardless of whether they are full-color or black-and-white.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An image forming apparatus being configured to print an image on a recording medium, the image being formed on a photoconductor, the image forming apparatus comprising:

an array of m light-emitting elements, the array extending in a main scanning direction, the array being disposed at a position adjacent to a surface of the photoconductor, the variable m being an integer satisfying the inequality: $m \geq 3$;

a memory that stores a cumulative light emission time of each of the m light-emitting elements;

a light intensity adjusting portion that obtains a light intensity adjusting value for the each light-emitting element, the light intensity adjusting value for adjusting a light intensity of the each light-emitting element;

an activating portion that controls the activation and deactivation of the each light-emitting element with reference to the light intensity adjusting value to form an electrostatic latent image on the surface of the photoconductor; and a selecting portion that selects n light-emitting elements from the m light-emitting elements, the n light-emitting elements being disposed on an end of the array extending in the main scanning direction, the variable n being an integer satisfying the inequality: $n \geq 2$ and $n < m$, wherein the activating portion forcibly activates the n light-emitting elements such that the cumulative light emission times of the n light-emitting elements are adjusted to a predetermined typical value, the predetermined typical value being less than the greatest value of cumulative light emission time among the m−n light-emitting elements.

2. The image forming apparatus according to claim 1, wherein, when the image is printed on the recording medium, the n light-emitting elements are less frequently used and the m−n light-emitting elements are more frequently used.

3. The image forming apparatus according to claim 1, wherein, when a print job specifies multiple sizes of recording medium for printing, the selecting portion selects the n light-emitting elements with reference to the size of the recording medium most used.

4. The image forming apparatus according to claim 1, wherein, when a print job specifies a smaller size of recording medium than that specified by a previous print job, the predetermined typical value is equal to the greatest value of cumulative light emission time among the n light-emitting elements.

5. The image forming apparatus according to claim 1, wherein, when a print job specifies an equal or larger size of recording medium to or than that specified by a previous print job, the predetermined typical value is equal to or greater than the greatest value of cumulative light emission time among the n light-emitting elements and is less than the greatest value of cumulative light emission time among the m−n light-emitting elements.

6. The image forming apparatus according to claim 1, wherein, while a print process is being terminated, the activating portion forcibly activates the n light-emitting elements such that the cumulative light emission times of the n light-emitting elements are adjusted to a predetermined typical value.

7. The image forming apparatus according to claim 1, wherein, when the activating portion forcibly activates the n light-emitting elements such that the cumulative light emission times of the n light-emitting elements are adjusted to a predetermined typical value, the light intensities are lower than those used in formation of an electrostatic latent image.

8. The image forming apparatus according to claim 1, wherein the activating portion forcibly and intermittently activates the n light-emitting elements such that the cumulative light emission times of the n light-emitting elements are adjusted to a predetermined typical value.

9. A light intensity adjusting method for an image forming apparatus being configured to print an image on a recording medium, the image being formed on a photoconductor, the image forming apparatus comprising:

an array of m light-emitting elements, the array extending in a main scanning direction, the array being disposed at a position adjacent to a surface of the photoconductor, the variable m being an integer satisfying the inequality: $m \geq 3$; and a memory that stores a cumulative light emission time of each of the m light-emitting elements, the light intensity adjusting method comprising:

obtaining a light intensity adjusting value for the each light-emitting element, the light intensity adjusting value for adjusting a light intensity of the each light-emitting element;

controlling the activation and deactivation of the each light-emitting element with reference to the light intensity adjusting value to form an electrostatic latent image on the surface of the photoconductor; and selecting n light-emitting elements from the m light-emitting elements, the n light-emitting elements being disposed on an end of the array extending in the main scanning direction, the variable n being an integer satisfying the inequality: $n \geq 2$ and $n < m$, wherein the n light-emitting elements are forcibly activated such that the cumulative light emission times of the n light-emitting elements are adjusted to a predetermined typical value, the predetermined typical value being less than the greatest value of cumulative light emission time among the m−n light-emitting elements.

10. The light intensity adjusting method according to claim 9, wherein, when the image is printed on the recording medium, the n light-emitting elements are used less frequently than the m−n light-emitting elements.

11. The light intensity adjusting method according to claim 9, wherein, when a print job specifies multiple sizes of recording medium for printing, the n light-emitting elements are selected with reference to the size of the recording medium most used.

12. The light intensity adjusting method according to claim 9, wherein, when a print job specifies a smaller size of recording medium than that specified by a previous print job, the predetermined typical value is equal to the greatest value of cumulative light emission time among the n light-emitting elements.

13. The light intensity adjusting method according to claim 9, wherein, when a print job specifies an equal or larger size of recording medium to or than that specified by a previous print job, the predetermined typical value is equal to or greater than the greatest value of cumulative light emission time among the n light-emitting elements and is less than the greatest value of cumulative light emission time among the m−n light-emitting elements.

14. The light intensity adjusting method according to claim 9, wherein, while a print process is being terminated, the n light-emitting elements are forcibly activated such that the cumulative light emission times of the n light-emitting elements are adjusted to a predetermined typical value.

15. The light intensity adjusting method according to claim 9, wherein, when the n light-emitting elements are forcibly activated such that the cumulative light emission times of the n light-emitting elements are adjusted to a predetermined typical value, the light intensities are lower than those used in formation of an electrostatic latent image.

16. The light intensity adjusting method according to claim 9, wherein the n light-emitting elements are forcibly and intermittently activated such that the cumulative light emission times of the n light-emitting elements are adjusted to a predetermined typical value.

* * * * *